US006161830A

United States Patent [19]

Yap

[11] Patent Number: 6,161,830

[45] Date of Patent: Dec. 19, 2000

[54] METHOD AND APPARATUS FOR STACKING MIXED MAIL

[75] Inventor: Anthony E. Yap, Danbury, Conn.

[73] Assignee: Pitney Bowes Inc., Stamford, Conn.

[21] Appl. No.: 09/393,068

[22] Filed: Sep. 8, 1999

[51] Int. Cl.[7] ..... B65H 29/38

[52] U.S. Cl. ..... 271/181; 414/798.7

[58] Field of Search ..... 271/2, 181; 414/798.7

[56] References Cited

U.S. PATENT DOCUMENTS

| | | | |
|---|---|---|---|
| 3,814,415 | 6/1974 | Hunter et al. | 271/181 |
| 4,019,730 | 4/1977 | Staudinger et al. | 271/181 |
| 4,940,219 | 7/1990 | Volat | 271/181 X |
| 4,951,934 | 8/1990 | Prins | 271/181 |
| 5,064,185 | 11/1991 | Ricciardi | 271/181 |
| 5,971,161 | 10/1999 | Branecky et al. | 271/181 X |

*Primary Examiner*—Janice L. Krizek

*Attorney, Agent, or Firm*—Steven J. Sapiro; Michael E. Melton

[57] ABSTRACT

A mixed mail stacking method and apparatus using a nip to ingest incoming mailpieces, a set of rollers to move the ingested mailpieces toward a registration wall, and a sensor upstream from the nip to detect the mailpieces. When the sensor detects the trailing edge of an ingested mailpiece, it causes the moving devices to pause, leaving a section of the ingested mailpiece sticking out of the nip. When the sensor detects the leading edge of the following mailpiece, it sets the moving devices in motion again so that the ingested mailpiece and the following mailpiece partially overlap when the following mailpiece is ingested by the nip. As such, the ingested mailpieces are shingled before they are moved toward the registration wall for stacking, preventing leading to trailing edge collisions. With the sensor to control the moving devices, the stacker is capable of stacking a wide variety of mail with a wide range of sizes without adjustment.

14 Claims, 9 Drawing Sheets

METHOD AND APPARATUS FOR STACKING MIXED MAIL

TECHNICAL FIELD

The present invention relates to a mail stacker and more particularly to a mail stacker with improved jam protection features.

BACKGROUND OF THE INVENTION

To stack the mail, most stackers use a constantly running roller and a stacking deck. Mail that is to be stacked enters the nip formed by the previous mailpiece (or a spring-loaded paddle) and the roller. When a mailpiece enters the nip, the roller drives it into the stacking deck. until the leading edge of the mailpiece hits a registration wall on the stacking deck. This roller is positioned a certain distance from the vertical wall to allow a portion of the mailpiece to stick out past the roller.

A typical prior art mixed mail stacker is shown in FIG. 1. As shown, the mixed mail stacker 110 includes a stacking deck 120 and a spring-loaded paddle 124 to support the stacked mailpieces 90. In addition, a registration wall 122 is used to align the leading edge of the stacked mailpieces. Incoming mailpieces are usually moved separately toward the mixed mail stacker 110 for stacking. In FIG. 1, reference numeral 100 denotes an incoming mailpiece which is moved by a moving device 128 toward an inlet nip 130 which is formed by an inlet roller 132 and an idler 134. After a mailpiece is ingested by the inlet nip 130, it is moved by the inlet roller 132 and the idler 134 until the trailing edge 97 has passed the inlet nip 130. As shown, as the leading edge 95 of a mailpiece 98 has passed the inlet nip 130, the mailpiece 98 continues to be moved toward the registration wall 122 by a nip 135 formed by a stacking roller 136 and the last mailpiece 108 of the stacked mailpieces 102. But for the first mailpiece 92 to be stacked, it is driven by a nip 135 formed by the stacking roller 136 and the paddle 124 after mailpiece 92 has passed the inlet nip 130. The inlet roller 132 and the stacking roller 136 are driven by a belt 138. After the mailpiece 98 is engaged in the stacking roller 136, its leading edge 95 is bent by the mailpieces already in the stack as illustrated. Therefore, the trailing edge 97 has a tendency to move away from the belt 138, leaving a gap 139 therebetween. When the next mailpiece 100 is ingested by the roller nip 130, the leading edge of the mailpiece 100 will enter the gap 139 between the mailpiece 98 and the belt 138.

The major disadvantage of this type of mixed mail stacker is that it is limited to handling, a very narrow range of mailpiece sizes without adjustment. In order that a mailpiece can be stacked, it must be long enough to have its leading edge engaged in the driven roller 136 before its trailing edge leaves the inlet nip 130. In this case, positive control of the mailpiece is always maintained. If the mailpiece is too short, it may not be engaged in the stacking roller 136 even after its trailing edge has left the roller nip 130. Thus, positive control is lost on that mailpiece. Consequently, the trailing edge of that short mailpiece may not separate from the belt 138. Not only is the mailpiece improperly stacked because the leading edge may not finally reach the registration wall, but its trailing edge may collide with the leading edge of the following mailpiece, possibly causing a mechanical jam or damage to the mailpieces. If, however, the mailpiece is too long, it cannot be stacked at all because its trailing edge cannot become disengaged from the roller nip 130. Thus, most stackers of this type can only handle a maximum, length variation of 2–3 inches.

It is advantageous and desirable to provide a stacker which can be used to stack mixed mailpieces having different sizes and thickness, such as ranging from a postcard (4"×5.5"×0.007" or 102 mm×140 mm×0.178 mm) to a large flat (12"×15"×0.5" or 305 mm×381 mm×12.7 mm), for example, without the need for adjusting the registration wall of the mixed mail stacking apparatus to fit the size of the mailpieces.

SUMMARY OF THE INVENTION

The present invention provides a method and an apparatus for stacking mixed mail. The mixed mail stacking apparatus, according to the present invention, is used for stacking a plurality of mailpieces incoming from an upstream direction into a mail stack after the mailpieces are ingested into the apparatus, wherein each mailpiece has a leading edge and a trailing edge. The apparatus comprises: a stacking deck for supporting the mail stack; a paddle movably positioned on the stacking deck for maintaining the mailpiece in the mail stack; a registration wall on the stacking deck to register the leading edge of the mailpieces in the mail stack; a nip for ingesting incoming mailpieces; a moving mechanism for moving the mailpieces toward the registration wall and the stacking deck; and a sensing device, located upstream of said moving mechanism, for sensing the mailpieces; wherein said moving mechanism is caused to pause in response to the sensing of a trailing edge by the sensing device, and said moving mechanism is caused to move in response to the sensing of a leading edge so as to allow the trailing edge of an ingested mailpiece to be partially overlapped with the leading edge of a following mailpiece so that the following mailpiece is farther from the paddle than the ingested mailpiece.

Accordingly, the method of stacking mixed mail, according to the present invention, includes the steps of: 1) sensing the leading edge of a first mailpiece incoming from the upstream direction; 2) moving the first mailpiece toward the registration wall responsive to the sensing of the leading edge; 3) ingesting the first mailpiece; 4) sensing the trailing edge of the ingested mailpiece; 5) pausing the ingested mailpiece in response to the sensing of the trailing edge of the ingested mailpiece; 6) sensing the leading edge of a following mailpiece incoming from the upstream direction; 7) moving the following mailpiece toward the registration wall; 8) causing the leading edge of the following mailpiece to overlap with the trailing edge of the ingested mailpiece such that the following mailpiece is further away from mail stack than the ingested mailpiece; 9) moving the ingested and following mailpieces toward the registration wall; 10) when the ingested mailpiece has reached the registration wall, stacking the ingested mailpiece on the stacking deck; and 11) ingesting the following mailpiece.

The method and apparatus of the present invention can be used to stack mailpieces of different sizes as well as mailpieces of the same size.

The method and apparatus for stacking mixed mail, according to the present invention, will become apparent upon reading the description below taken in conjunction with FIG. 2 to FIG. 4.

Detailed Description

Figure 1:
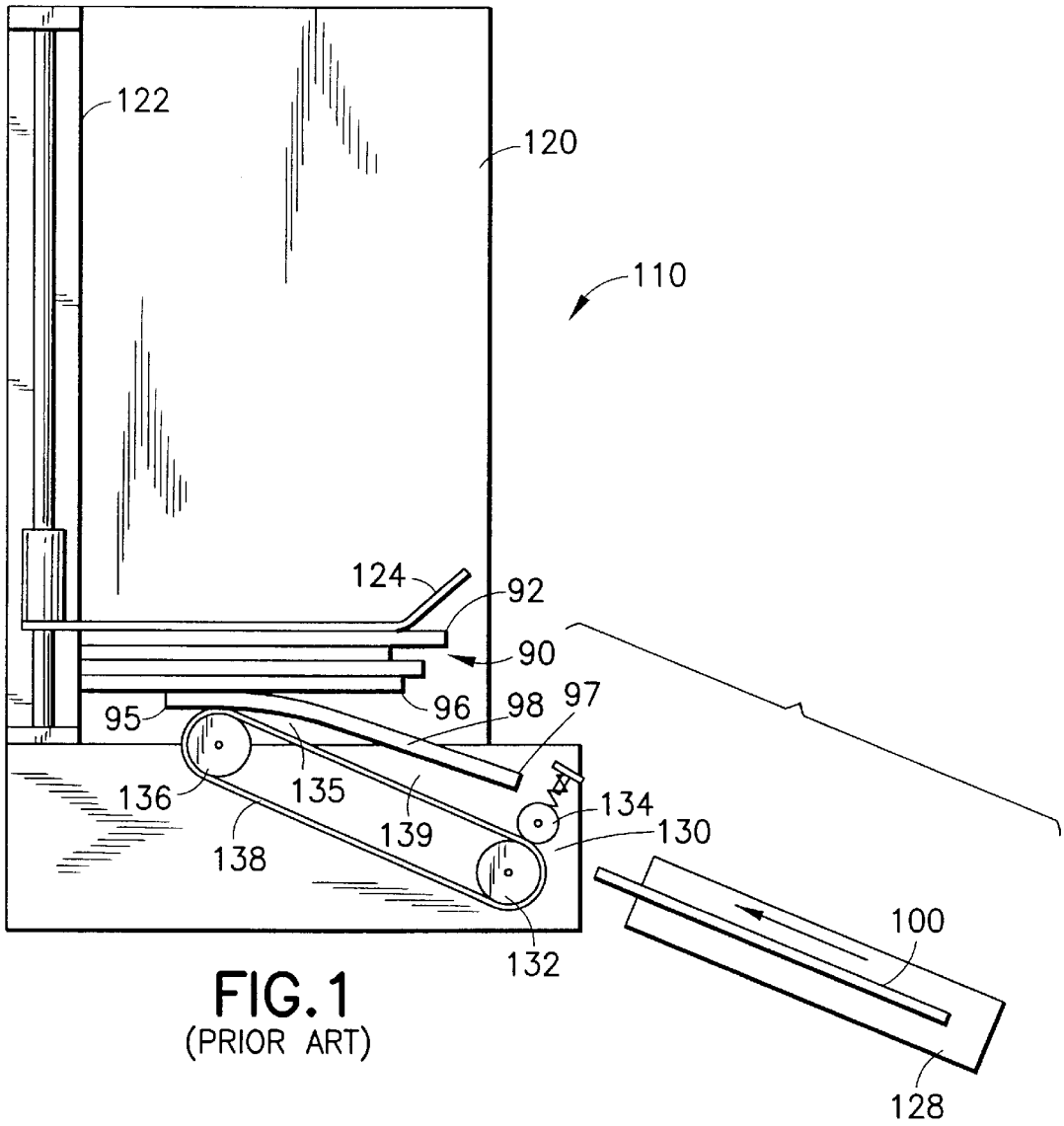
FIG. 1 (PRIOR ART)
FIG. 1 illustrates a prior art mixed mail stacker.
Figure 2:
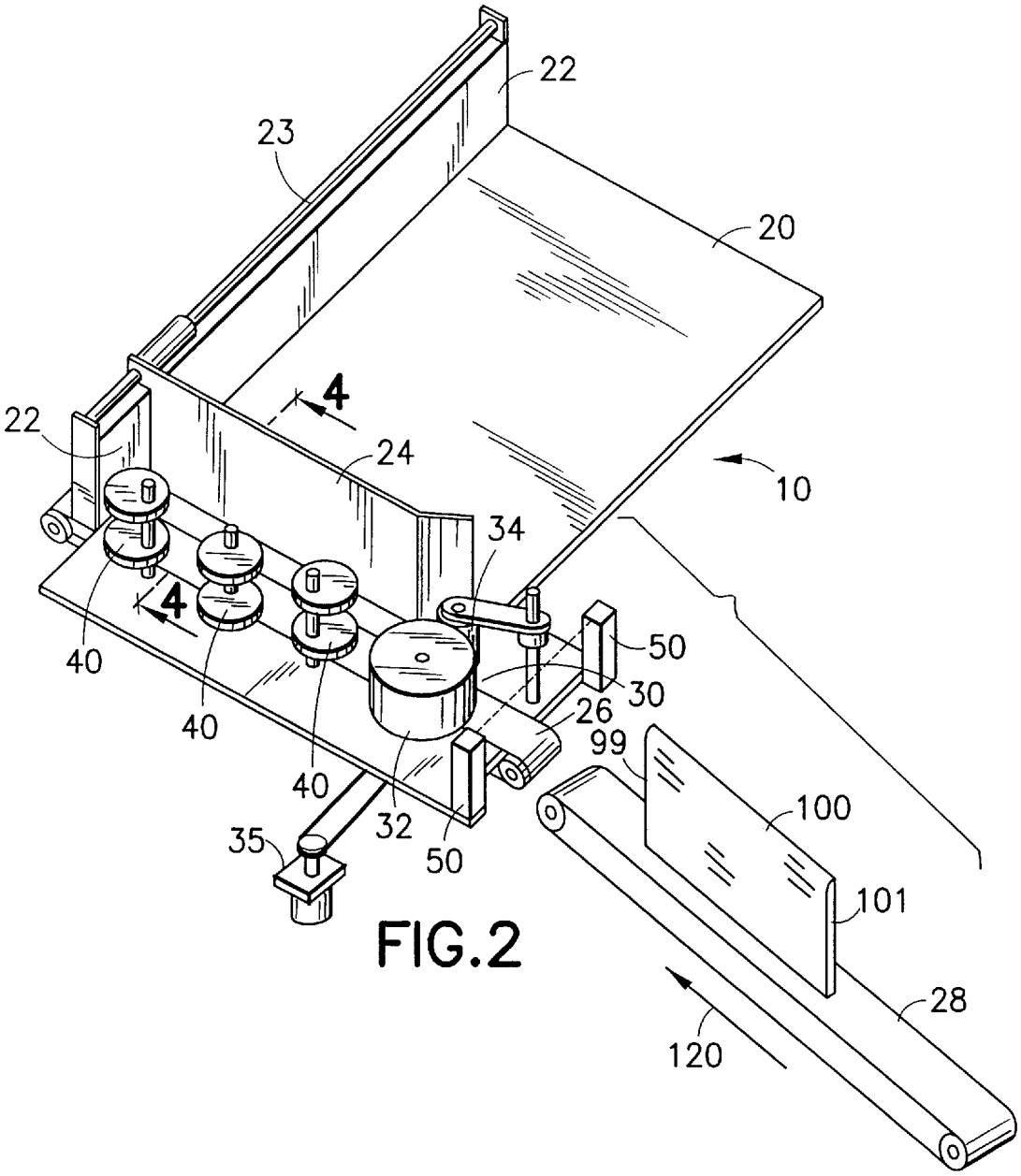
FIG. 2 shows an isometric view of a stacker, according to the present invention.

FIG. 2 shows an isometric view of a mixed mail stacker 10 for stacking a mailpiece 100 having a leading edge 99 and a trailing edge 101 along with a plurality of following mailpieces which are not shown. The mailpiece 100 moves from an upstream direction as shown by the arrow 120 and is transported by a moving device 28 shown in one simple form as a driven belt system. The stacker 10 includes a stacking deck 20, a registration wall 22 against which the mailpieces 100 are registered as the mailpieces 100 are being stacked on the stacking deck 20, and a spring loaded paddle 24 movably mounted on a shaft 23 to keep the stacked mailpieces in place by biasing them toward eccentric rollers 40 as discussed in more detail below. As shown, an inlet roller 32 and an idler 34, which is biased by a spring (not shown) to move toward inlet roller 32, are used to form a roller nip 30 to ingest an incoming mailpiece 100. The eccentric rollers 40 are used to transport the ingested mailpieces toward the registration wall 22 before and after the mailpieces exit out of the roller nip 30. In that respect, any ingested mailpiece is under positive control of the mixed mail stacker 10 until it is properly stacked on stacking deck 20. In FIG. 2 there is shown a driven bottom belt 26 which is used to move incoming mailpieces 100 toward the roller nip 30 and onwards toward the registration wall 22. A sensor pair 50 is used to sense the edges of an incoming mailpiece 100. Preferably, sensor pair 50 is an optical sensor, but it can also be any device, electrical or mechanical, that can be used to detect the edges of a mailpiece 100.

Figure 3A:
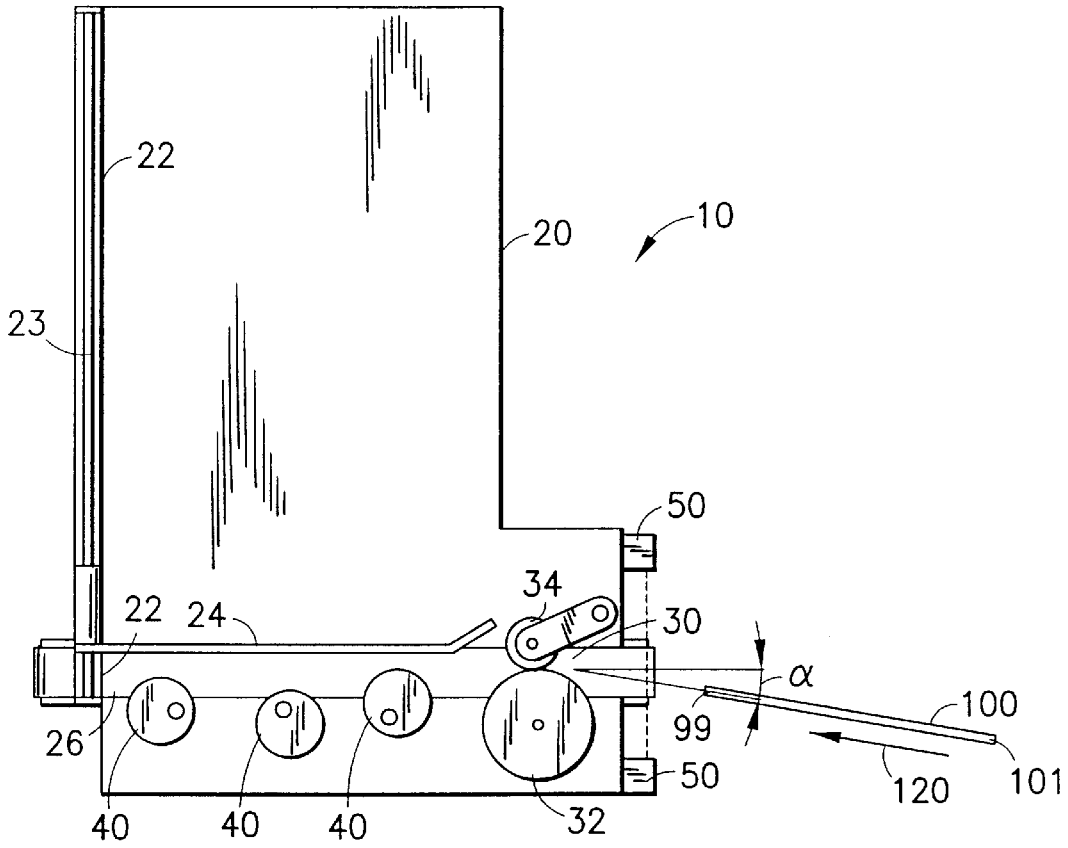
FIGS. 3A–3F are each top plane views of the stacker according to the present invention, which combine to show the operation principle of the present invention.

Preferably, all the eccentric rollers 40 and the inlet roller 32 are driven by a roller motor 35 and linked together in order to have matched velocities. Bottom belt 26 is preferably driven by roller motor 35 in order to have a matching velocity with the eccentric rollers 40. Of course it can be driven by a separate motor. Initially, the roller motor is not turned on, as shown in FIG. 3A.

Figure 3B:
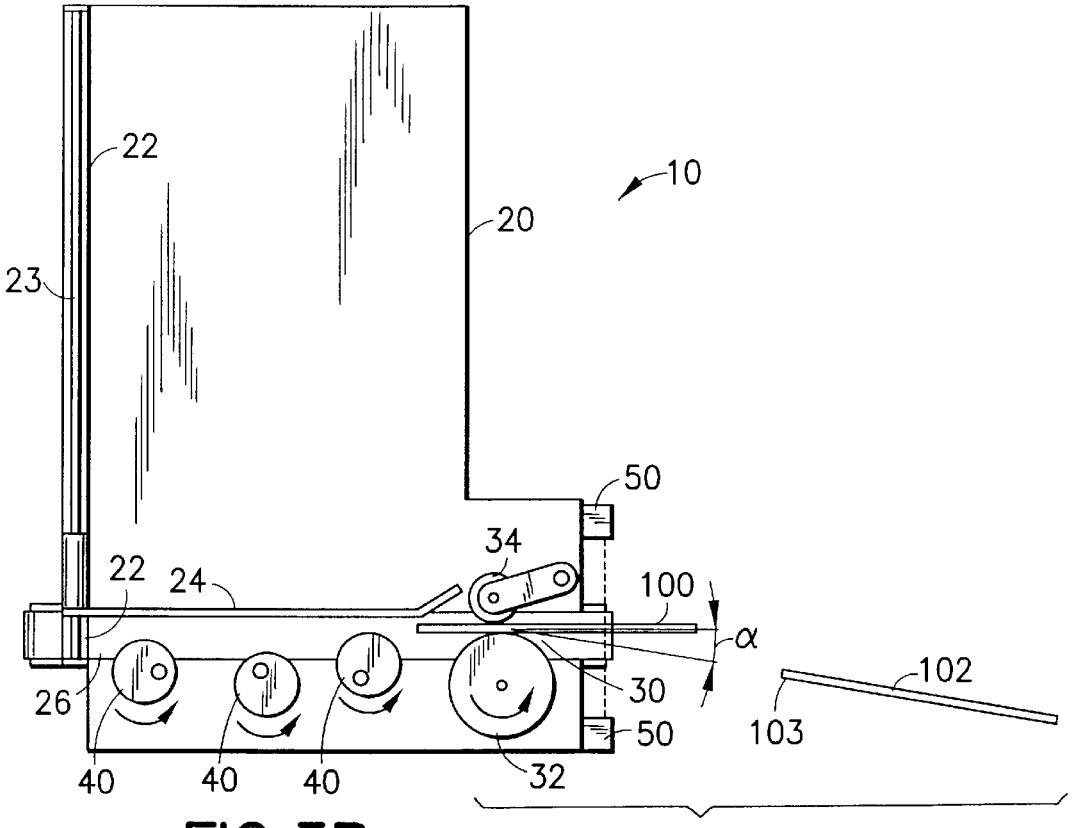

When sensor 50 senses the leading edge 99 of the incoming mailpiece 100, it causes the roller motor to turn on, setting roller 32 and eccentric rollers 40 in motion. Before the mailpiece 100 reaches the roller nip 30, it is transported toward the roller nip 30 by moving device 28 (FIG. 2) or by the bottom belt 26 if the bottom belt 26 is driven by a separate motor which is not caused to stop by the sensor 50. When the mailpiece 100 enters the roller nip 30, the inlet roller 32, the idler 34 and the bottom belt 216 drive the mailpiece 100 toward the registration wall 22, as shown in FIG. 3B.

Preferably, incoming mailpiece 100 enters the roller nip 30 at an angle $\alpha$ with respect to the bottom belt 26. After the mailpiece 100 is ingested by the roller nip 30 and transported toward the registration wall 22, it has a tendency to straighten itself such that the length of the mailpiece 100 is substantially parallel to the bottom belt 26, as shown in FIG. 3B. The preferred range for angle $\alpha$ is from 10 to 30 degrees. However, the angle $\alpha$ can be smaller than 10 degrees or larger than 30 degrees.

Figure 3C:
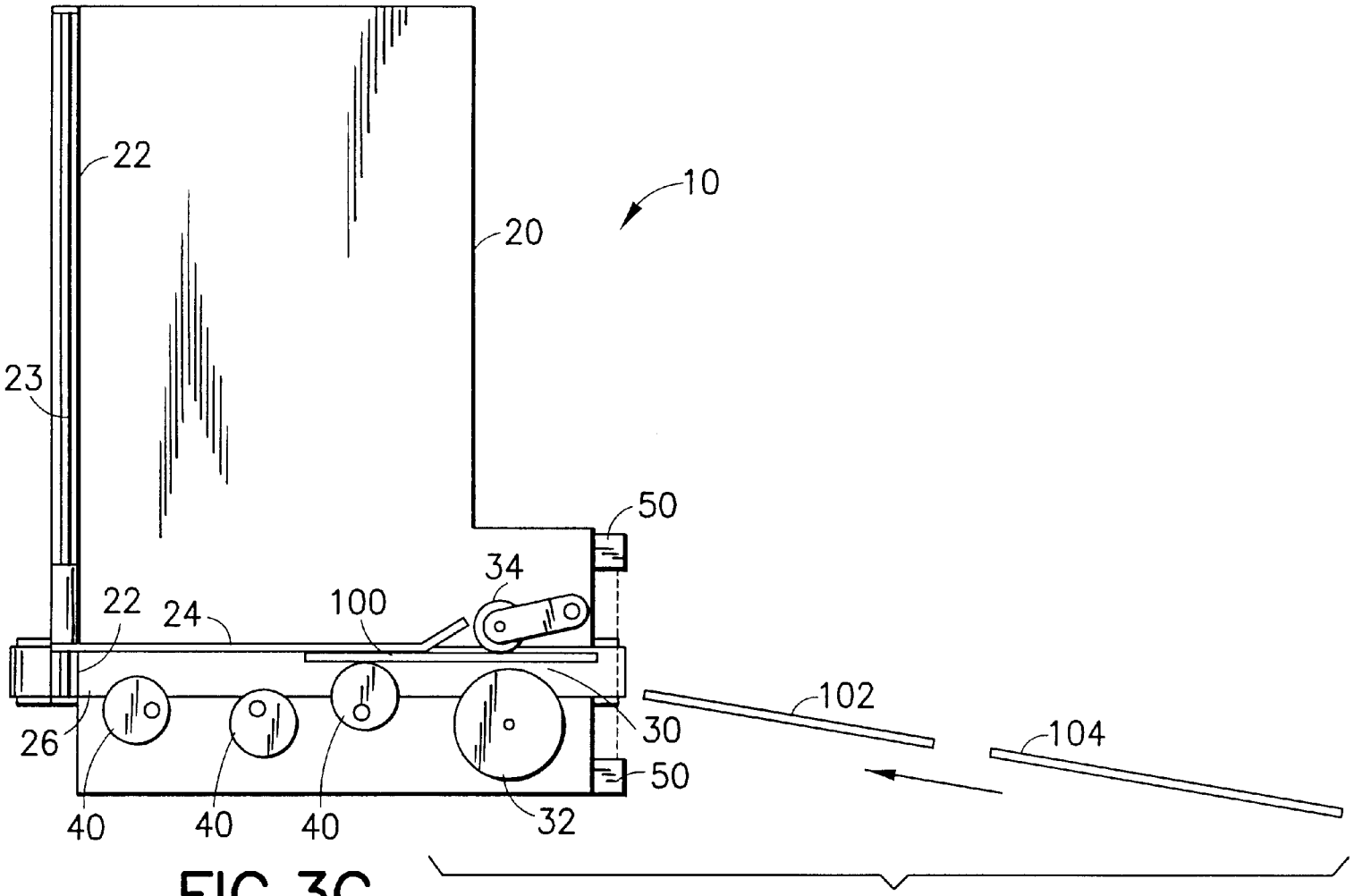

Mailpiece 100 is moved by the rollers 32, 40 toward the registration wall 22 until its trailing edge 101 is detected by the sensor pair 50. When this occurs, the roller motor will shut off, causing mailpiece 100 to stop, leaving the trailing edge 101 of the mailpiece to extend out of the inlet roller nip 30, as shown in FIG. 3C.

Figure 3D:
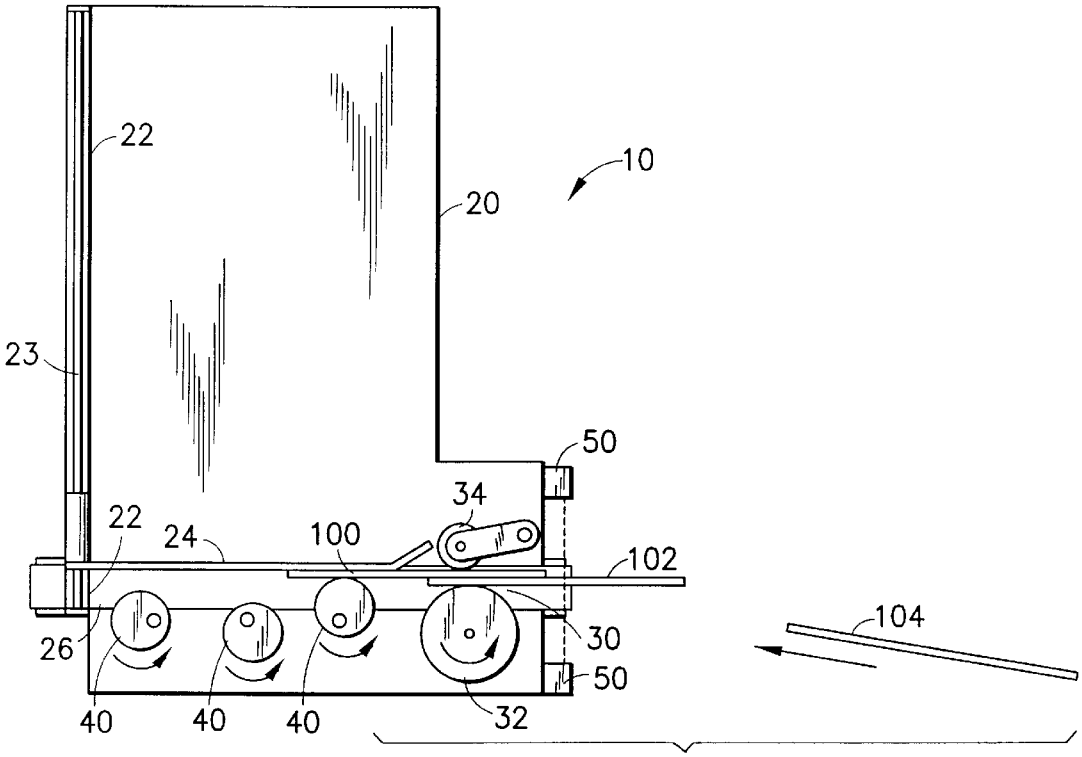

When the following mailpiece 102 is moved toward the mixed mail stacker 10 and its leading edge 103 is detected by sensor 50, the roller motor is caused to turn on again. Mailpiece 102 is directed between the nip 30 formed by inlet roller 32 and the previously ingested mailpiece 100. The time required to accelerate roller 32 and eccentric rollers 40 to full speed is designed to allow following mailpiece 102 to catch up to the ingested mailpiece 100 so that the mailpieces 100, 102 are partially overlapped with each other, as shown in FIG. 3D.

Figure 3E:
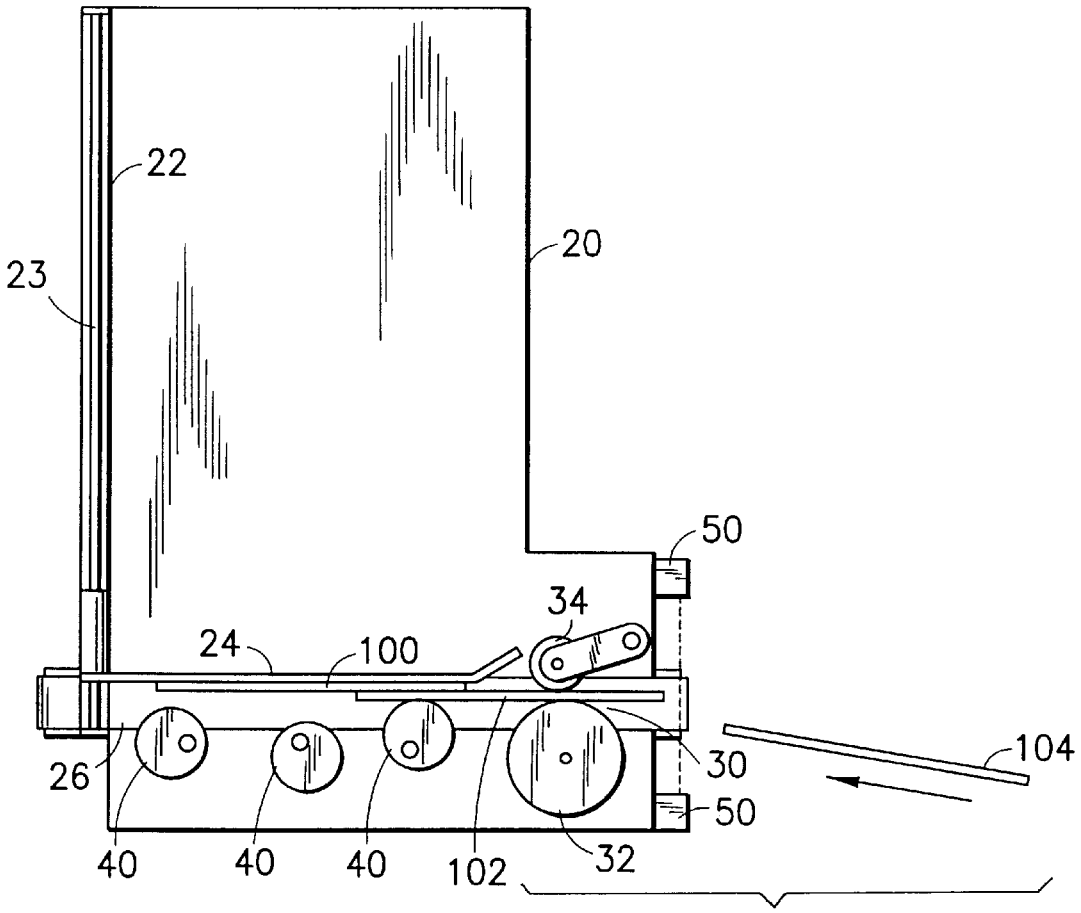

It is preferable that by the time mailpiece 102 reaches the roller nip 30, the roller motor has reached full speed. Mailpiece 102 is then ingested into the nip 30 and moved along with mailpiece 100. Both mailpieces 100, 102 are moved toward the registration wall 24 until the trailing edge of mailpiece 102 is detected by the sensor 50. When that happens, the motor is again shut off until a third mailpiece 104 arrives, as shown in FIG. 3E . The cycle is repeated until all the incoming mailpieces are stacked.

Figure 3F:
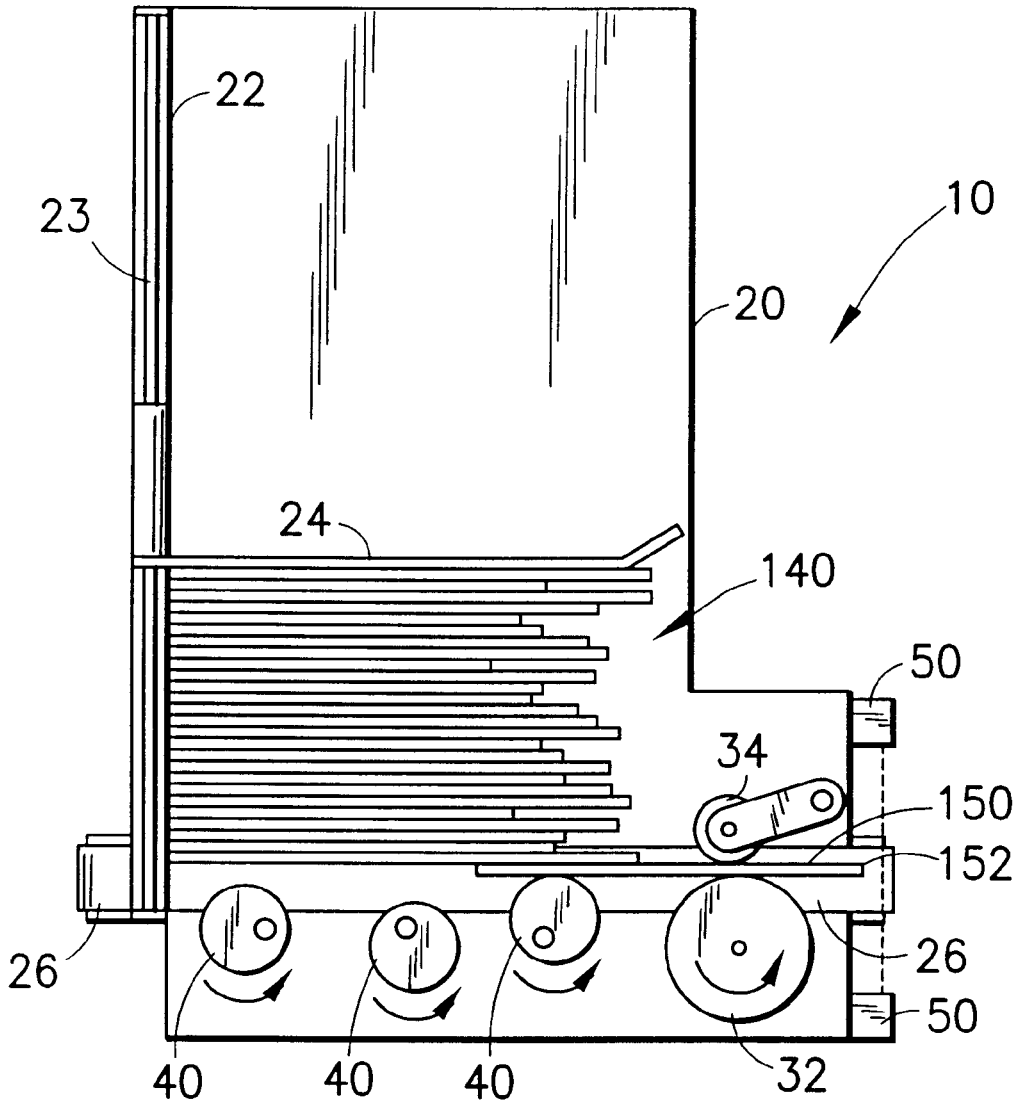

In the stacking process, each mailpiece is driven into the stacking deck 20 until its leading edge hits the registration wall 22 on the stacking deck 20. With the stacking method according to the present invention, the mailpiece is caused to change from a singulated state to a shingled state with two adjacent mailpieces being slightly overlapped at the stacker inlet, thereby preventing leading edge to trailing edge collision that can cause a machine jam and/or damage the mailpieces. All mailpieces that are upstream from the roller nip 30 are shingled at the roller nip 30 so that they are transported toward the registration wall 22 in an orderly fashion. After exiting out of the roller nip 30, the shingled mailpieces are transported onto the stacking deck 20 by the bottom belt 26 and the eccentric rollers 40. Running the bottom belt 26 and the eccentric rollers 40 causes the mailpieces to move toward the registration wall 22 onto the stacking deck 20, with the leading edge of each mailpiece contacting the registration wall 22 as it forms part of the overall mail stack 140 as shown in FIG. 3F. Since the mailpieces are already shingled, no leading edge to trailing edge collision can occur, down to the last mailpiece 150. It should be noted that the mixed mail stacker 10 can be programmed to recognize the presence of the last mailpiece 150 so that even after the trailing edge 152 of the last mailpiece 150 has been detected by sensors 50, inlet roller 32 and eccentric rollers 40 are caused to continue turning until the last 150 mailpiece is stacked into the mail stack 140.

Figure 4:
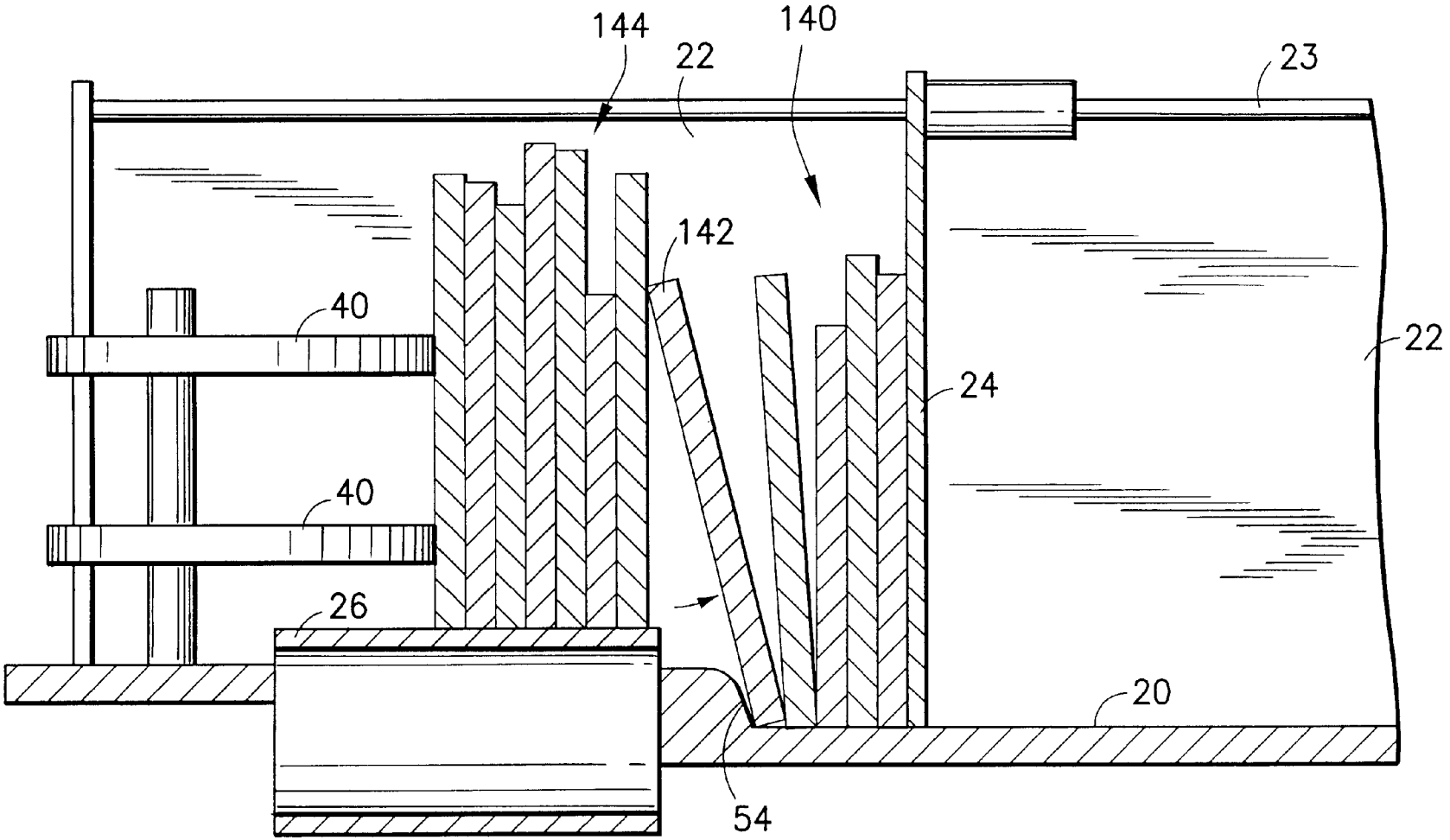
FIG. 4 is a view of the stacker taken along line 4—4 in FIG. 2 showing a ledge in the stacker for preventing the mailpieces in the stacking deck from moving toward the rollers.

The eccentric rollers 40 help to relieve the pressure of the mailpieces in the stack by pushing the ingested mailpieces off bottom belt 26 onto the stacking deck 20. Thus as a mailpiece is pushed off the bottom belt 26, it falls off a small ledge 54, as shown in FIG. 4. Shown in FIG. 4, a mailpiece 142 is being pushed off the ledge 54 to become part of an overall mail stack 140. Ledge 54 prevents the spring-loaded paddle 24 from pushing the mailpieces in stack 140 including mailpiece 142 back onto the bottom belt 26. With the stack pressure relieved, the bottom belt 26 can effectively drive the mailpieces 144 toward the registration wall 22.

It should be noted that the present invention has been described with respect to a mixed mail stacker. It will be understood, however, that the same invention can be used for stacking other items as well. For example, the stacker can be used to stack documents, enclosure material to be inserted into envelopes, and so forth. Furthermore, the items to be stacked can be of the same size, or of different sizes. Therefore, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An apparatus for stacking a plurality of mailpieces incoming from an upstream direction into a mail stack after the mailpieces are ingested into the apparatus, wherein each mailpiece has a leading edge and a trailing edge, said apparatus comprising:

a stacking deck for supporting the mail stack;

a registration wall on the stacking deck to register the leading edge of the mailpieces in the mail stack;

a paddle movably positioned on the stacking deck so as to maintain the mailpieces in the mail stack;

means for ingesting incoming mailpieces;

means for moving the mailpieces toward the registration wall; and means, located upstream of said moving means, for sensing the mailpieces;

wherein said moving means is caused to pause in response to the sensing of a trailing edge by the sensing means, and said moving means is caused to move in response to the sensing of a leading edge so as to allow the trailing edge of an ingested mailpiece to overlap with the leading edge of a following mailpiece such that the following mailpiece is farther from the paddle than the invested mailpiece.

2. The apparatus of claim 1, wherein the paddle is movably positioned with respect to the stacking deck so as to support the mail stack formed between the paddle and the moving means.

3. The apparatus of claim 1, wherein said moving means comprises a bottom belt over which incoming mailpieces and ingested mailpieces are transported.

4. The apparatus of claim 3 further comprising means for pushing off ingested mailpieces from the bottom belt onto the stacking deck into the mail stack.

5. The apparatus of claim 4 further comprising a ledge for preventing the mailpieces in the mail stack from being pushed back onto the bottom belt.

6. The apparatus of claim 4, wherein the pushing off means comprises at least one eccentric roller.

7. The apparatus of claim 1, wherein the ingesting means comprises at least one roller to form a roller nip, wherein the sensing means is located upstream of the roller nip.

8. The apparatus of claim 7, wherein the moving means comprises at least one eccentric roller located downstream from the roller nip.

9. The apparatus of claim 1, wherein the sensing means comprises at least one optical sensor.

10. A method of stacking a plurality of mailpieces sequentially incoming from an upstream direction so as to form a mail stack on a stacking deck, wherein each mailpiece has a leading edge and a trailing edge and the mailpieces in the mail stack are registered against a registration wall, said method comprising the steps of:

1) sensing the leading edge of a mailpiece as the mailpiece is incoming from the upstream direction;

2) moving the mailpiece toward the registration wall in response to sensing its leading edge;

3) continuing the movement of the mailpiece toward the registration wall until the trailing edge of the mailpiece is sensed, at which time said movement of the mailpiece is paused;

4) sensing the leading edge of a next following mailpiece incoming from the upstream direction;

5) moving the next following mailpiece and the previous mailpiece toward the registration wall so as to cause the leading edge of the next following mailpiece to overlap with the trailing edge of the previous mailpiece and so that the next following mailpiece is further away from the resulting mail stack than the previous mailpiece;

6) continuing the movement of the next following and previous mailpiece toward the registration wall so that each previous mailpiece is moved into contact with the registration wall and to then form part of the mail stack as it is urged onto the stacking deck by the next following mailpiece, said movement of the next following mailpiece continuing until the trailing edge of the next following mailpiece is sensed, at which time said movement of the next following mailpiece is paused; and 7) repeating steps 4 through 6 for the remaining mailpieces of said plurality of mailpieces.

11. The method of claim 10, wherein the leading edge of the following mailpiece in step 4 forms an non-zero angle with the trailing edge of an ingested mailpiece.

12. The method of claim 11, wherein the angle is ranging from 10 to 30 degrees.

13. The method of claim 11, wherein the angle is smaller than 10 degrees.

14. The method of claim 11, wherein the angle is larger than 30 degrees.

* * * * *